US005927352A

United States Patent [19]

Wouters et al.

[11] Patent Number: 5,927,352

[45] Date of Patent: Jul. 27, 1999

[54] DEVICE FOR DISCHARGING POWDER CONTAINED IN A BAG

[75] Inventors: Paul Wouters, O.L.Waver; Patrick Van den Bergen, Hove, both of Belgium

[73] Assignee: Agfa-Gevaert N.V., Mortsel, Belgium

[21] Appl. No.: 09/074,327

[22] Filed: May 7, 1998

[30] Foreign Application Priority Data

May 13, 1997 [GB] United Kingdom ..... 9709637

[51] Int. Cl.[6] ..... B65B 1/04; B65B 3/04

[52] U.S. Cl. ..... 141/330; 141/346; 141/364; 141/366; 222/166; 222/534; 222/553

[58] Field of Search ..... 141/330, 284, 141/233, 366, 310, 320, 322, 340, 346, 363, 364, 365, 2, 18, 114; 222/553, 165, 534, 166, 81, 164; 128/203.15; 604/58

[56] References Cited

U.S. PATENT DOCUMENTS 3,618,826 11/1971 Kangas ..... 222/166
4,120,420 10/1978 Dirksing ..... 220/416
4,523,834 6/1985 Pelda et al. ..... 355/3 DD
5,813,192 9/1998 White ..... 53/381.2

*Primary Examiner*—Steven O. Douglas
*Assistant Examiner*—Peter deVore
*Attorney, Agent, or Firm*—Baker & Botts, L.L.P.

[57] ABSTRACT

The device comprises a housing (10) having a powder inlet opening (12) in an upper face (13) thereof. A dust shield (14) upstands from the upper face (13) adjacent said powder inlet opening (12). A movable box (16) for accommodating a bag (18) containing powder has an open end (20). Co-operating guides (22, 24) provided respectively on the housing (10) and on the box (16) constrain movement of the box (16) between a first position in which the open end (20) is closed by the dust shield (14) and a second position in which the open end (20) mates with the powder inlet opening (12) to allow powder from the bag (18) to fall through the powder inlet opening (12). Thereby, discharge of the powder contents of a flexible material bag can be achieved in a convenient manner.

16 Claims, 5 Drawing Sheets

DEVICE FOR DISCHARGING POWDER CONTAINED IN A BAG

DESCRIPTION

FIELD OF THE INVENTION

This invention is related to a device and method for the discharge of powder from a bag, in particular to the discharge of a powder component into the housing of a mixing device.

BACKGROUND OF INVENTION

There are a number of widely used processes which involve the repeated supply of a component in powder form to a processing apparatus. For example, photographic processing chemicals may be supplied in powder form to be dissolved in water before use. Such powders are often supplied in flexible material bags, especially polyethylene bags, of various sizes.

With existing mixing devices, the operator simply cuts open the bag and throws the contents into the mixer. This action results in dust which is inconvenient for the user. Dust can be reduced where the bag is of a sufficient length to hang over the upper edge of a mixer housing with its open end below the level of liquid therein. A drawback of this solution is that when a user takes the emptied bag out of the mixer, the bag is wet due to the contact with the wet chemistry in the mixer.

OBJECTS OF INVENTION

It is an object of the present invention to provide a device and method for discharging the powder contents of a flexible material bag in a more convenient manner.

SUMMARY OF THE INVENTION

According to a first aspect of the invention, there is provided a device for discharging powder contained in a bag comprising: a housing having a powder inlet opening in an upper face thereof; a dust shield upstanding from the upper face adjacent the powder inlet opening; a movable box for accommodating a bag containing powder and having an open end; and co-operating guide means provided respectively on the housing and on the box for constraining movement of the box between a first position in which the open end is closed by the dust shield and a second position in which the open end mates with the powder inlet opening to allow powder from the bag to fall through the powder inlet opening.

According to a second aspect of the invention, there is provided a method of discharging powder contained in a bag comprising: placing the bag in a box having an open end; locating the box in a first position against an upper face of a housing, the housing comprising a dust shield upstanding from the upper face in such a position as to close the open end of the box; cutting open the bag; and moving the box from the first position to a second position in which the open end of the box mates with a powder inlet opening in the upper face of the housing to allow powder from the bag to fall through the powder inlet opening.

The box preferably has cross-sectional dimensions greater than the dimensions of the powder inlet opening in the housing, so as to ensure that dust cannot escape through the inlet opening. Preferably, the box has a lid which can be opened to allow the bag to be placed in the box. When the lid is closed, a part of the bag, such as a trailing edge part, may be trapped between co-operating edges provided respectively on a lid of the box and on a wall of the box base to prevent the bag from falling through the powder inlet opening when the box is in the second position. In an alternative embodiment, a clamp device for holding the bag may be provided in the box. After emptying, the bag may be removed from the box through a slot. The slot may be defined by the co-operating edges on the box and the lid, the slot allowing the bag to be removed from the box after emptying without opening the lid. This action ensures that substantially all the contents of the bag have been discharged.

The box may include means for cutting open the bag accommodated therein. These cutting means may be provided either on the box or on the housing. Alternatively, the bag may be cut by hand.

Ideally, the box is rotated from the first position to the second position. Thus, the co-operating guide means preferably constrain the box to rotational movement between the first and second positions. The co-operating guide means may be constituted by pivot pins extending from the box, sized and positioned to engage in guide slots in guide rails on the mixer housing. The guide rails are preferably integral with the dust shield. When the pivot pins are engaged in the guide slots, the box is restrained to movement in a lateral direction towards and away from the dust shield. When the pivot pins reach the ends of the guide slots, the box is restrained to rotational movement about the axis of the pivot pins. This rotational movement extends from a first, ideally generally horizontal, position in which the open end of the box is closed by the dust shield and a second, ideally generally vertical, position in which the open end of the box mates with the powder inlet opening in the housing. A releasable locking device may be provided to prevent the un-intended removal of the box before the contents of the bag have been discharged. The first position is, for example, at least 90° from the second position. This ensures that little if any powder can escape from the bag in its first position, while maximum discharge of the powder from the bag is achieved in the second position.

The box may have an interior surface carrying an anti-static covering layer, to assist in the complete discharge of the powder into the housing.

The dust shield is preferably so shaped as to follow the path taken by the open end of the box, as the box is moved from the first position to the second position. Where the co-operating guide means constrain the box to rotational movement between the first and second positions about a pivot axis, the dust shield may have a closing face curved about the pivot axis.

The box is advantageously provided with an exterior surface curved about the pivot axis and so positioned as to move in face-to-face relationship with the dust shield closing face as the box is moved from the first position to the second position.

The housing may be a mixer housing adapted to contain at least one other component to be mixed with the powder. For example, the housing may contain a liquid, into which the powder is to be dispersed or dissolved.

DETAILED DESCRIPTION OF THE INVENTION

The invention will be described by the following illustrative embodiments with reference to the accompanying drawings without the intention to limit the invention thereto, and in which.

Figure 1:
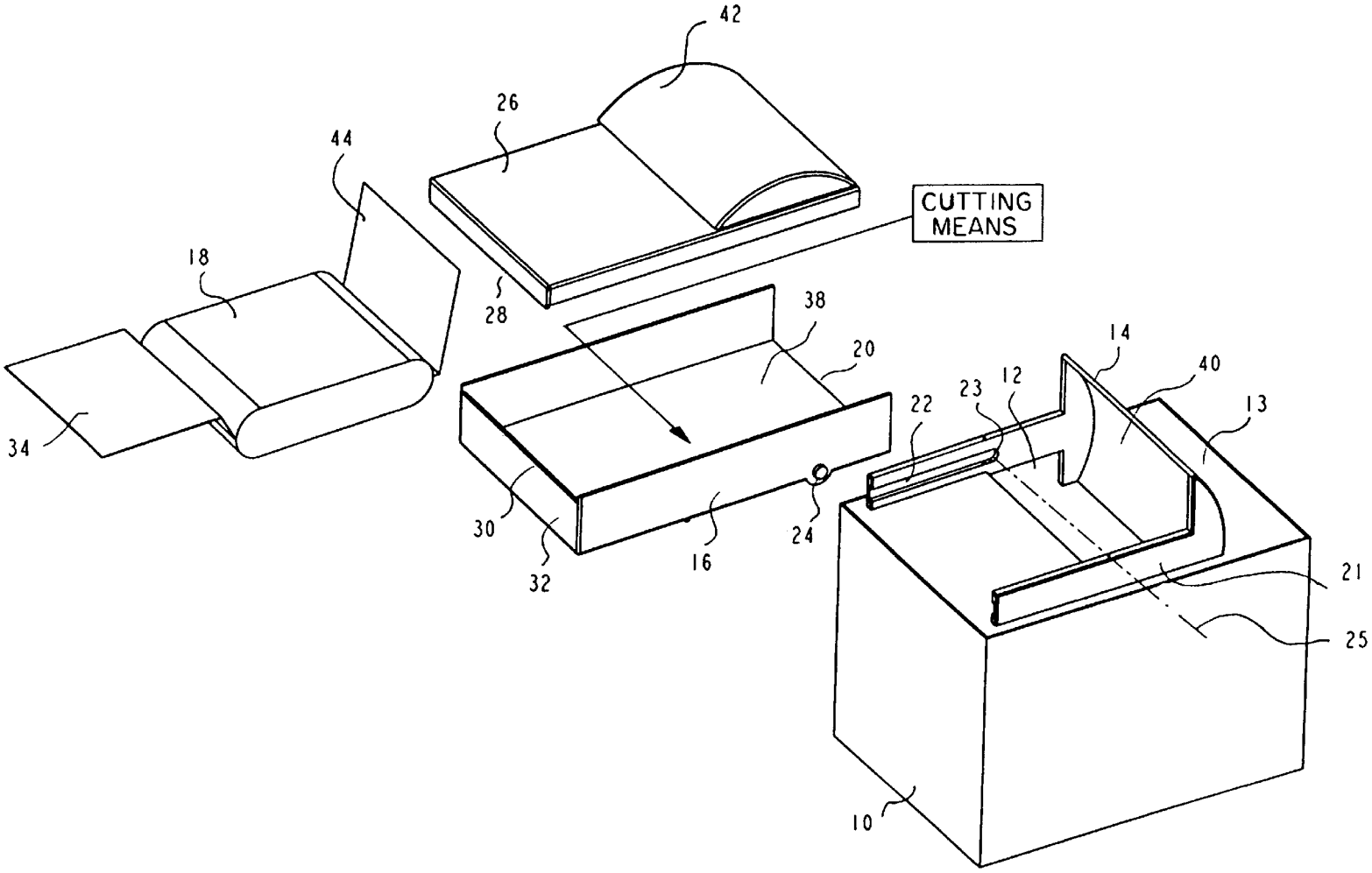
FIG. 1 shows a device according to the present invention in exploded view.
Figure 2:
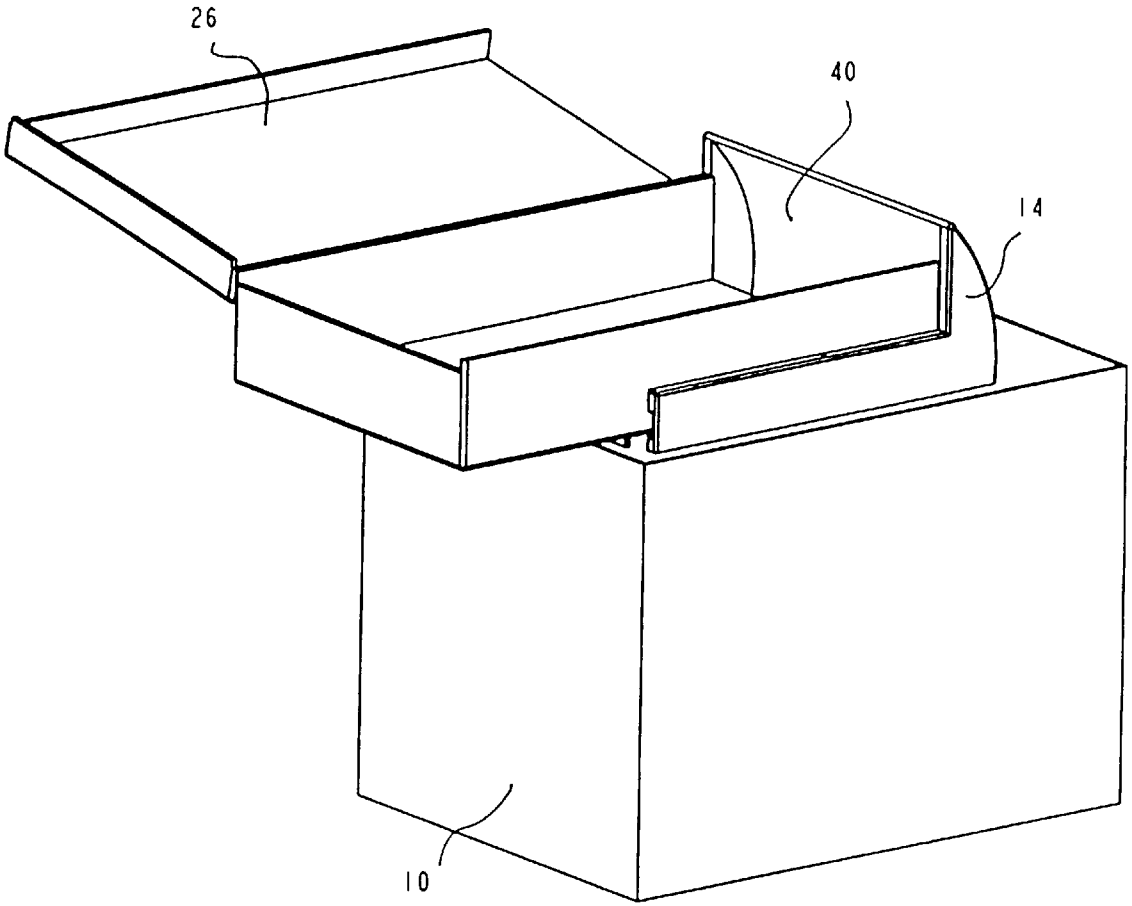
FIG. 2 shows the device shown in FIG. 1, in an assembled position, with the box mounted in a horizontal position on the housing, the box lid being open.
Figure 3:
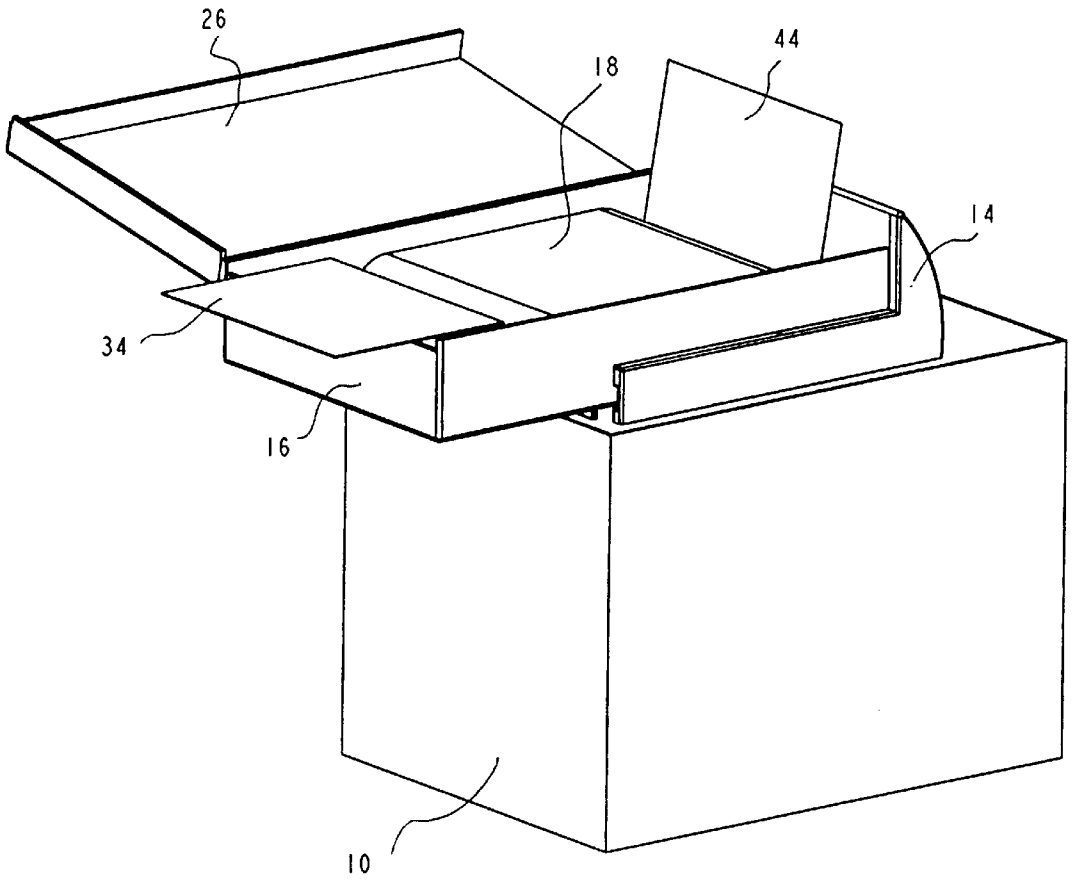
FIG. 3 is a view similar to FIG. 2, but with the powder containing bag inserted in the box.
Figure 4:
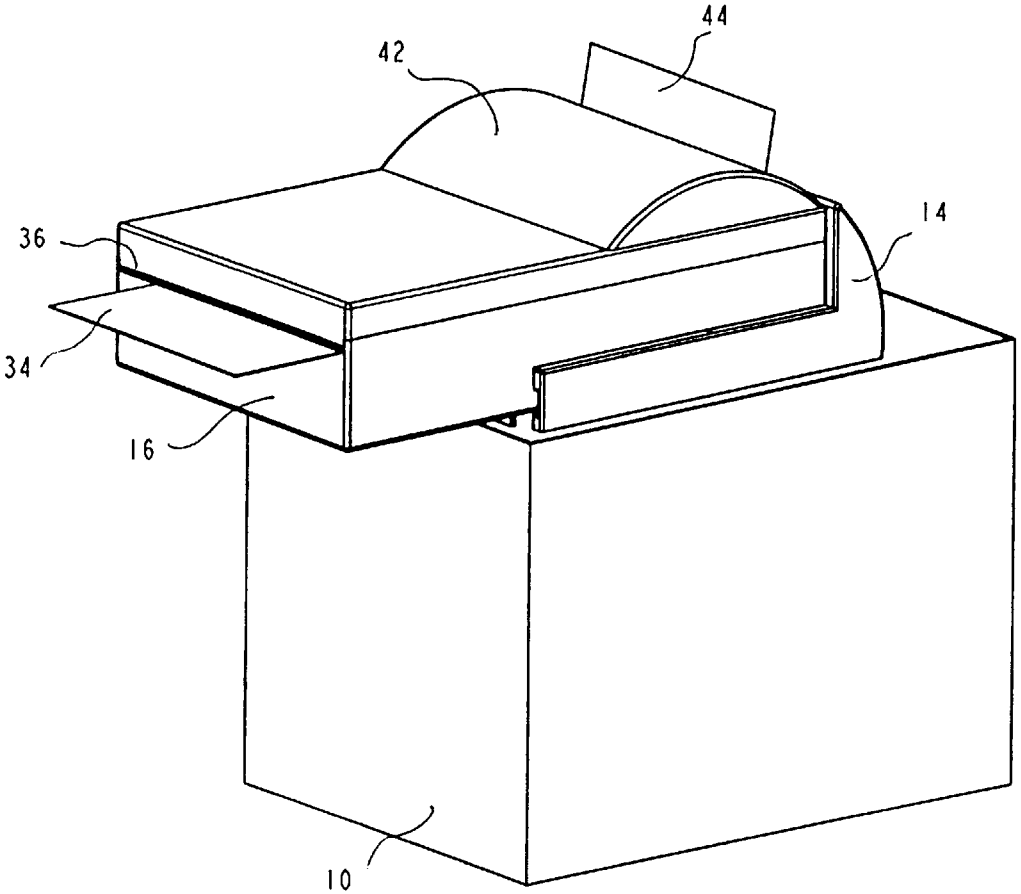
FIG. 4 is a view similar to FIG. 3, but with the box lid closed.
Figure 5:
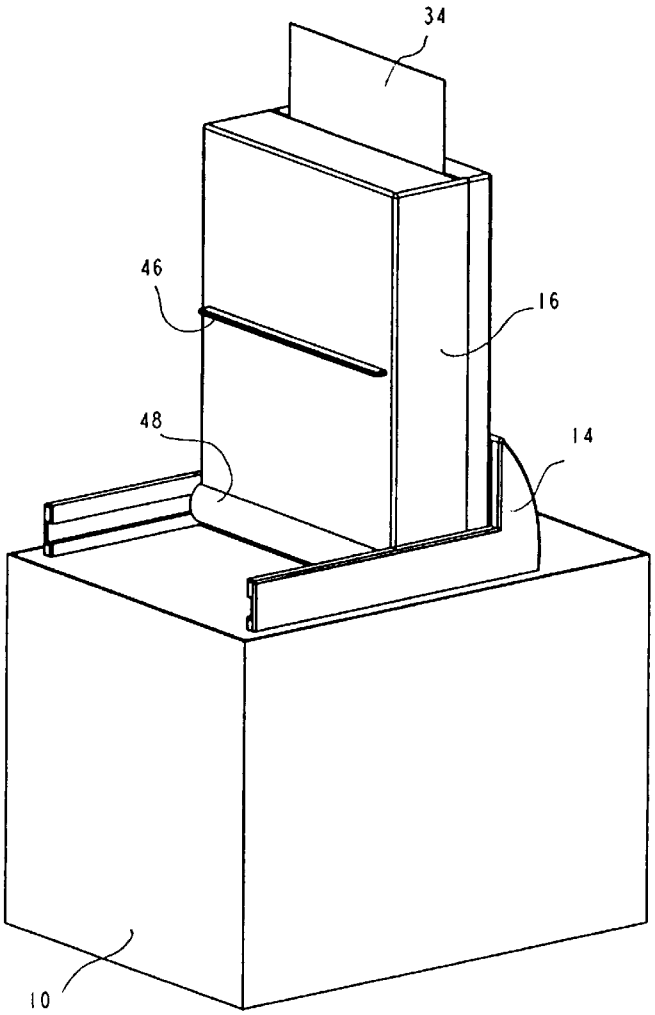
FIG. 5 is a view similar to FIG. 4, but with the box in its vertical position.

The device shown in the drawings comprises a housing 10 and a movable box 16 for accommodating a bag 18 containing powder.

The housing 10 is a mixer housing of generally rectangular cross-section, containing, for example, a liquid component to be mixed with the powder. A rectangular powder inlet opening 12 is provided in an upper face 13 of the housing. A dust shield 14 upstands from the upper face 13 immediately adjacent the powder inlet opening 12. Guide rails 21, integral with the dust shield 14, are positioned on the upper face 13 of the housing 10. Guide slots 22 are provided in the guide rails 21, these slots being open at their ends remote from the dust shield 14 and having curved closed ends 23 adjacent the dust shield 14.

The box 16 is generally rectangular in cross-section, with a hinged lid 26 which can be opened to allow the bag 18 to be placed in the box 16. The box 16 has an open end 20, the cross-sectional dimensions of which are greater than the dimensions of the powder inlet opening 12 in the housing 10. Pivot pins 24 extend from each end of a curved rib 48 provided on the underside of the box. These pivot pins 24 are sized and positioned to engage in the guide slots 22 on the mixer housing 10. When the pivot pins 24 are engaged in the guide slots 22, the box 16 is restrained to movement in a lateral direction towards and away from the dust shield 14. When the pivot pins 24 reach the curved ends 23 of the guide slots 22, the box 16 is restrained to rotational movement about the axis of the pivot pins 24. This rotational movement extends from a first, generally horizontal, position in which the open end 20 is closed by the dust shield 14 and a second, generally vertical, position in which the open end 20 mates with the powder inlet opening 12.

The horizontal position is defined by the abutment of a ridge 46 provided on the underside of the box 16, with the upper face 13 of the housing 10. The vertical position is defined by the abutment of the lid 26 on the dust shield 14. The vertical position is at least 90° from the horizontal position, and is preferably slightly beyond top dead centre. The axes of the pivot pins 24 and the centre line of the curved slot ends 23 constitutes a pivot axis 25, about which the box 16 is able to rotate. The pivot pins 24 and the guide slots 22 may be so shaped and sized in a known manner (not shown in detail in the drawings), to prevent rotation of the box 16 in any position except where the pivot pins 24 are located at the curved ends 23 of the slots 22 and a releasable locking device may be provided to prevent the un-intended removal of the box 16 before the contents of the bag 18 have been discharged.

Opposite to the open end 20, the base of the box 16 has a generally closed end 32, the upper edge 30 of which defines a slot 36 with an edge 28 of the lid 26. These co-operating edges 28, 30 trap a trailing edge part 34 of the bag 18 in place when the lid 26 is closed. The slot 36 allows the bag 18 to be removed from the box 16 after emptying without opening the lid 26. The box 16 has an interior surface 38 carrying an anti-static covering layer.

The dust shield 14 is so shaped as to follow the path taken by the open end of the box 16, as the box 16 is moved from the horizontal position to the vertical position. The dust shield 14 has a closing face 40 curved about the pivot axis 25 and the lid 26 of the box 16 is provided with an exterior surface 42 curved about the pivot axis 25 and so positioned as to move in face-to-face relationship with the dust shield closing face 40 as the box 16 is moved from the horizontal position to the vertical position.

The device is used as follows. After hinging open the lid 26, an un-opened bag 18 is placed in the box 16 with its trailing edge part 34 hanging over the edge 30 of the box 16 and a top edge part 44 of the bag extending through the open box end 20. The lid 26 is now closed, thereby defining the slot 36 through which the bottom end part 34 of the bag extends and is trapped thereby. The box 16 is located in its horizontal position against the upper face 13 of the housing 10, by engaging the pivot pins 24 in the slots 22 and sliding the box 16 towards the dust shield 14 up to the position where the dust shield 14 closes the open end 20 of the box 16. Alternatively, the box 16 is placed in the aforesaid horizontal position before the bag 18 is placed therein.

The top edge part 44 of the bag 18 is cut open with a knife or scissors. The box 16 is rotated from the horizontal position to the vertical position in which the open end 20 of the box 16 mates with the powder inlet opening 12 in the upper face 13 of the housing 10 to allow powder from the bag 18 to fall through the powder inlet opening 12. The trailing edge part 34 of the bag 18 is trapped between co-operating edges 28, 30 provided respectively on the lid 26 of the box 16 and on the wall 32 of the box 16 to prevent the bag 18 from falling through the powder inlet opening 12 when the box 16 is in the vertical position. After emptying, the bag 18 is removed from the box 16 by pulling through the slot 36 in the box 16, this action ensuring that substantially all the contents of the bag have been discharged. When the box is returned to its horizontal position, any dust remains inside the mixer housing 10 because the dust shield 14 and the box 16 itself cover the powder inlet opening 12.

| Reference Number List | |
|---|---|
| housing 10 | pivot axis 25 |
| inlet opening 12 | lid 26 |
| upper face 13 | edge 28 |
| dust shield 14 | upper edge 30 |
| box 16 | closed end 32 |
| bag 18 | part 34 |
| open end 20 | slot 36 |
| Guide rails 21 | interior surface 38 |
| Guide slots 22 | closing face 40 |
| curved closed ends 23 | exterior surface 42 |
| Pivot pins 24 | top edge 44 |
| | ridge 46 |
| | curved rib 48 |

We claim:

1. A device for discharging powder contained in a bag comprising: a housing (10) having a powder inlet opening (12) in an upper face (13) thereof; a dust shield (14) upstanding from said upper face (13) adjacent said powder inlet opening (12); a movable box (16) for accommodating a bag (18) containing powder and having an open end (20); and co-operating guide means (22, 24) provided respectively on said housing (10) and on said box (16) for constraining movement of said box (16) between a first position in which said open end (20) is closed by said dust shield (14) and a second position in which said open end (20) mates with said powder inlet opening (12) to allow powder from said bag (18) to fall through said powder inlet opening (12).

2. A device according to claim 1, wherein said box (16) has a lid (26) which can be opened to allow said bag (18) to be placed in said box (16).

3. A device according to claim 2, wherein co-operating edges (28, 30) are provided respectively on said lid (26) and on a wall (32) of said box (16) to trap a part (34) of said bag (18) in place when said lid (26) is closed, whereby said bag (18) is prevented from falling through said powder inlet opening (12) when said box (16) is in said second position.

4. A device according to claim 3, wherein said co-operating edges are such as to define a slot (36) allowing said bag (18) to be removed from said box (16) after emptying without opening said lid (26).

5. A device according to claim 1, wherein including means for cutting open said bag (18) accommodated in said box (16).

6. A device according to claim 1, wherein said co-operating guide means (22, 24) constrain said box (16) to rotational movement between said first and second positions.

7. A device according to claim 6, wherein said first position is at least 90° from the second position.

8. A device according to claim 1, wherein said box (16) has an interior surface (38) carrying an anti-static covering layer.

9. A device according to claim 1, wherein said dust shield (14) is so shaped as to follow the path taken by said open end of said box (16), as said box (16) is moved from said first position to said second position.

10. A device according to claim 9, wherein said co-operating guide means (22, 24) constrain said box (16) to rotational movement between said first and second positions about a pivot axis (25), and said dust shield (14) has a closing face (40) curved about said pivot axis (25).

11. A device according to claim 10, wherein said box (16) is provided with an exterior surface (42) curved about said pivot axis (25) and so positioned as to move in face-to-face relationship with said dust shield closing face (40) as said box (16) is moved from said first position to said second position.

12. A device according to claim 1, wherein said housing (10) is a mixer housing adapted to contain at least one other component to be mixed with said powder.

13. A method of discharging powder contained in a bag comprising: placing said bag (18) in a box (16) having an open end (20); locating said box (16) in a first position against an upper face (13) of a housing (10), said housing comprising a dust shield (14) upstanding from said upper face (13) in such a position as to close said open end (20) of said box (16); cutting open said bag (18); and moving said box (16) from said first position to a second position in which said open end (20) of said box (16) mates with a powder inlet opening (12) in said upper face (13) of said housing (10) to allow powder from said bag (18) to fall through said powder inlet opening (12).

14. A method according to claim 13, wherein said box (16) is rotated from said first position to said second position.

15. A method according to claim 13, wherein a part (34) of said bag (18) is trapped between co-operating edges (28, 30) provided respectively on a lid (26) of said box (16) and on a wall (32) of said box (16) to prevent said bag (18) from falling through said powder inlet opening (12) when said box (18) is in said second position.

16. A method according to claim 13, wherein, after emptying, said bag (18) is removed from said box (16) through a slot (36) in said box (16).

* * * * *